US006607397B1

(12) United States Patent
Zhang et al.

(10) Patent No.: US 6,607,397 B1
(45) Date of Patent: Aug. 19, 2003

(54) ELECTRICAL CONNECTOR WITH ENHANCED MATING MECHANISM

(75) Inventors: Jian Qiang Zhang, Kunshan (CN); Li Qi Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/290,826

(22) Filed: Nov. 8, 2002

(30) Foreign Application Priority Data

May 30, 2002 (TW) ..... 91207934 U

(51) Int. Cl.[7] ..... H01R 13/54
(52) U.S. Cl. ..... 439/357; 439/607
(58) Field of Search ..... 439/607–610, 439/350, 352, 357, 358

(56) References Cited

U.S. PATENT DOCUMENTS 5,197,901 A * 3/1993 Hashiguchi ..... 439/352
5,380,223 A * 1/1995 Marsh et al. ..... 439/610
5,934,942 A 8/1999 Patel et al.
5,941,725 A 8/1999 Brennan et al.
6,165,017 A * 12/2000 Kuo ..... 439/610
6,280,227 B1 * 8/2001 Terada et al. ..... 439/357
6,290,530 B1 * 9/2001 Chang ..... 439/378

* cited by examiner

*Primary Examiner*—Hien Vu
(74) *Attorney, Agent, or Firm*—Wei Te Chung

(57) ABSTRACT

An electrical connector (1) adapted to mate with a complementary connector (90) which has a tongue portion (91) with a plurality of conductive terminals (92) disposed thereon, includes an insulative housing (50) having a mating portion (53) protruding forwardly therefrom and a receiving cavity (55) defined therethrough, and a plurality of conductive contacts (60) received in the cavity of the housing. An upper wall (531) and a lower wall (532) form the mating portion, with the receiving cavity being defined therebetween. The contacts are positioned on the lower wall. A pair of engaging bars (551) protrudes from the upper wall into the receiving cavity. When the mating portion mates with the tongue portion, the engaging bars downwardly push the tongue portion to ensure a reliable connection between the conductive terminals and corresponding contacts.

5 Claims, 5 Drawing Sheets

ELECTRICAL CONNECTOR WITH ENHANCED MATING MECHANISM

BACKGROUND OF THE INVENTION

1. Field of the Invention

The present invention relates to an electrical connector, and more particularly to an input/output (I/O) plug connector having an enhanced mating mechanism for ensuring a reliable connection with a receptacle connector.

2. Description of the Prior Art

Input-output (I/O) connectors have been used at connection interfaces between computers and telecommunication networks. One type of I/O connector is in the form of an I/O plug adapted for mating with a receptacle connector. Example of this type of plugs are disclosed in U.S. Pat. Nos. 5,941,725 and 5,934,942. Such an I/O plug generally has a low-profile mating portion defining a rectangular cavity and has a plurality of conductive contacts received in a lower or an upper wall of the mating portion. The receptacle connector generally has a tongue portion with a plurality of terminals assembled thereon. When the I/O plug mates with the receptacle connector, the tongue portion of the receptacle connector is inserted into the mating portion of the plug so that the terminals of the receptacle connector electrically engage with the contacts of the I/O plug. The dimensions of the tongue portion of the receptacle connector should be a bit less than these of the cavity of the I/O plug.

However, it is difficult to control the dimensions of a connector and the alignment of mating portions of contacts received therein. If the dimensions of the tongue portion of the receptacle connector are too small relative to those of the cavity of the I/O plug, a loose fit may be created therebetween, which results in an unreliable connection between the plug and the receptacle connector. If the dimensions of the tongue portion of the receptacle connector are too close to those of the cavity of the I/O plug, in order to ensure a tight mating therebetween, it will be inconvenient for a user to insert the tongue portion into the cavity because of the overly-fight fit. In addition, if alignment of the mating portions of either the plug or the receptacle connector is not ensured, a reliable connection between the contacts of the plug and receptacle connectors may not be obtained.

Hence, an electrical connector with an enhanced mating mechanism is required to overcome the disadvantages of the prior art devices as disclosed above.

BRIEF SUMMARY OF THE INVENTION

A main object of the present invention is to provide an electrical connector having an enhanced mating mechanism to ensure a reliable connection with a mating connector.

A second object of the present invention is to provide an electrical connector having an enhanced mating mechanism with a simple configuration to reduce manufacturing cost.

An electrical connector according to the present invention includes an insulative housing and a plurality of contacts. The housing has a mating portion protruding forwardly therefrom. A receiving cavity is defined therethrough, and the plurality of conductive contacts is received in the cavity of the housing. An upper and a lower walls are formed on opposite sides of the receiving cavity. The contacts are positioned on the lower wall. A pair of engaging bars depends from the upper wall into the receiving cavity.

A complementary connector for mating with the above electrical connector includes a tongue portion with a plurality of conductive terminals disposed thereon. When the mating portion of the electrical connector mates with the tongue portion of the complementary connector, the engaging bars downwardly push the tongue portion to ensure a reliable connection between the conductive terminals and corresponding contacts.

Other objects, advantages and novel features of the invention will become more apparent from the following detailed description when taken in conjunction with the accompanying drawings.

DETAILED DESCRIPTION OF THE INVENTION

Figure 1:
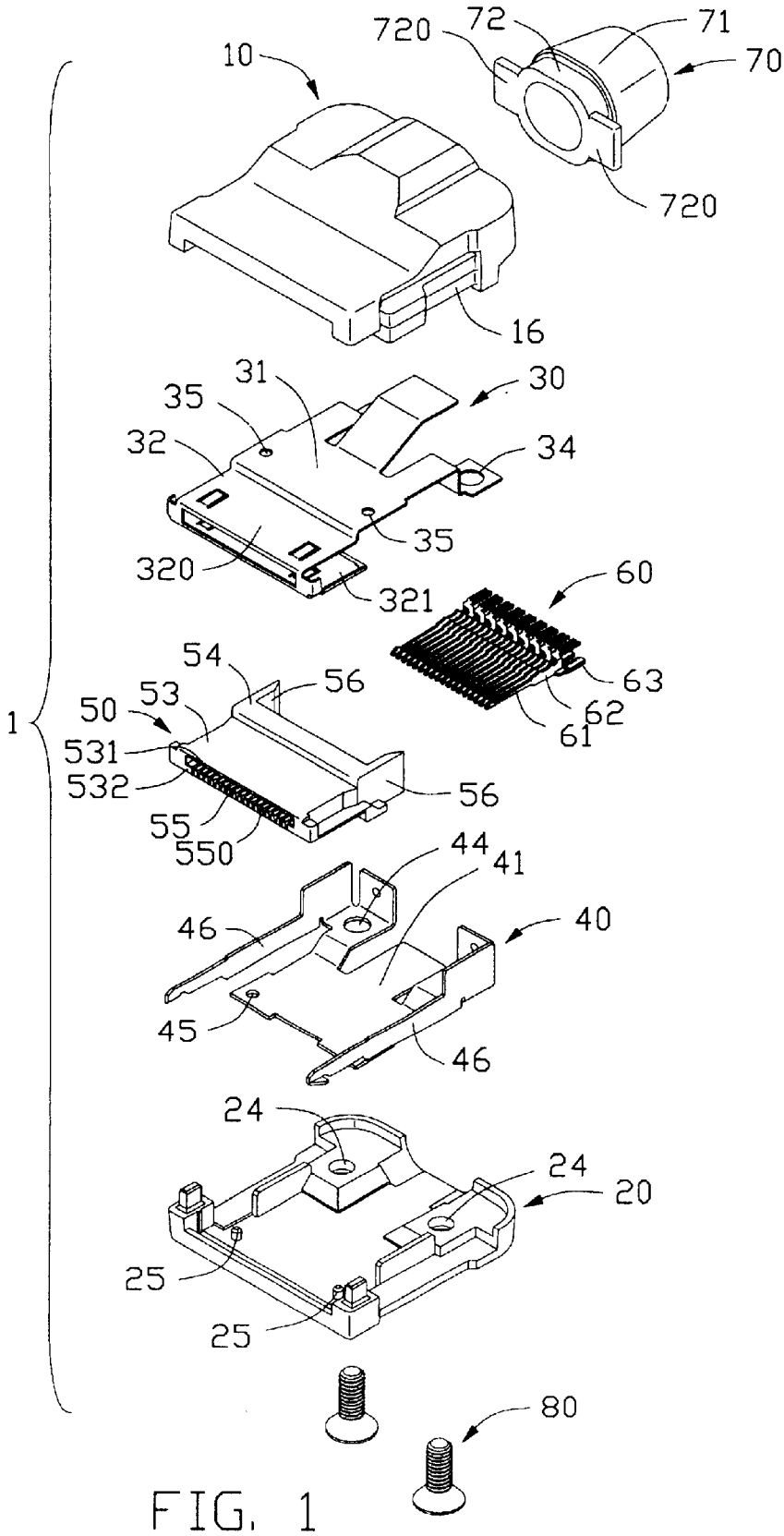
FIG. 1 is an exploded perspective view of an electrical connector according to the present invention.
Figure 2:
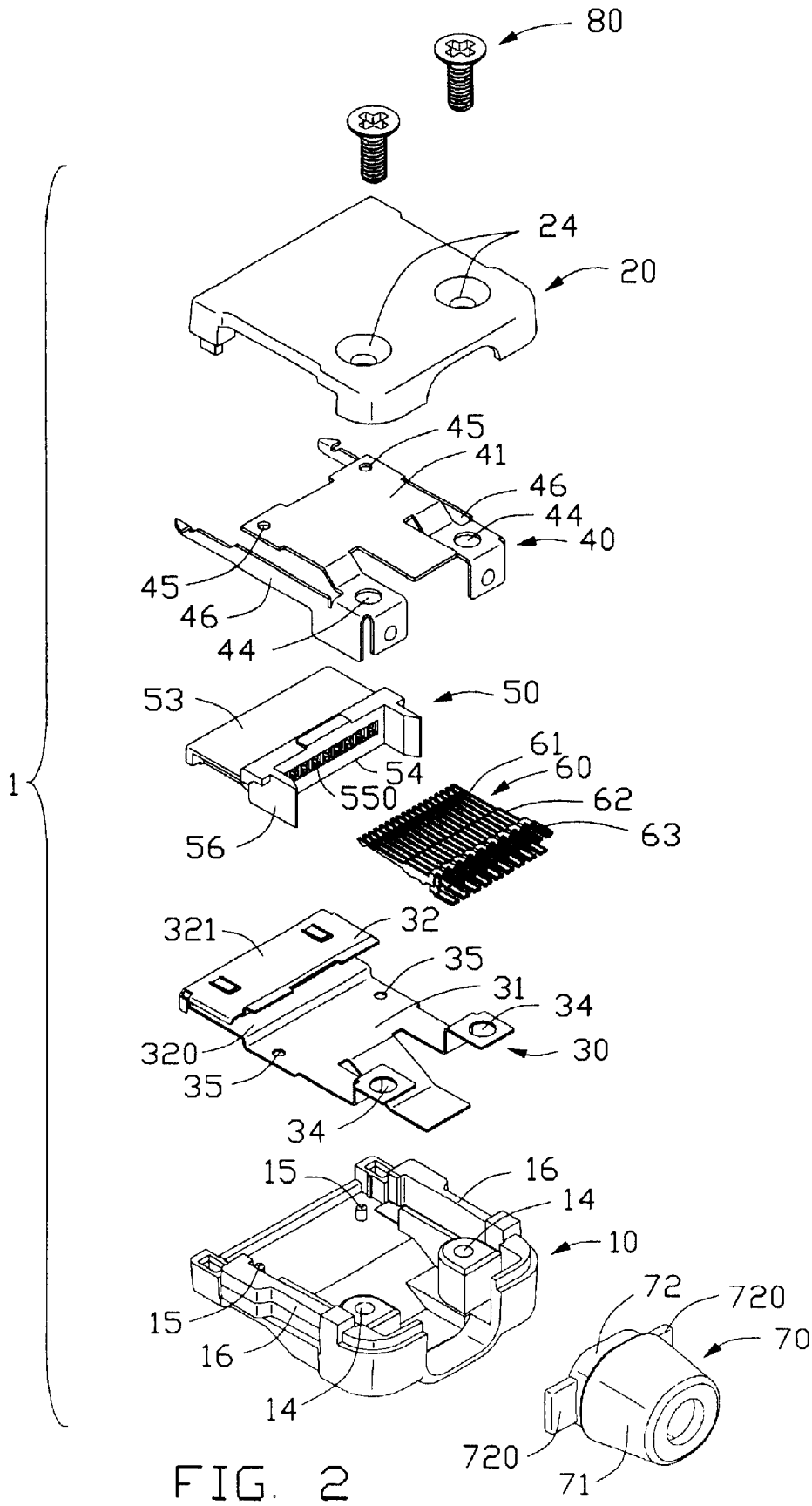
FIG. 2 is another exploded perspective view of the connector of FIG. 1.

Referring to the drawings and particularly to FIGS. 1 and 2, an electrical connector 1 in accordance with the present invention comprises a dielectric upper cover 10, a dielectric lower cover 20, a metallic upper shield 30, a metallic lower shield 40, a dielectric housing 50, a plurality of conductive contacts 60, a strain relief 70 and a pair of screws 80.

The dielectric housing 50 comprises a low profile mating portion 53, a rear portion 54 extending rearwardly from the mating portion 53, and a pair of tail portions 56 extending rearwardly from two opposite sides of the rear portion 54. The mating portion 53 and the rear portion 54 together define a receiving cavity 55 therethrough. An upper wall 531 and a lower wall 532 are thus formed on opposite sides of the receiving cavity 55. A row of passageways 550 are defined in the lower wall 532 and communicate with the receiving cavity 55.

Each contact 60 has a contacting portion 61, a soldering portion 63, and a connecting portion 62 connecting the contacting portion 61 with the soldering portion 63.

The upper shield 30 has a head portion 32 including an upper panel 320 and a lower panel 321 parallel to the upper panel 320. A body portion 31 extends rearwardly from the upper panel 320.

The lower shield 40 has a bottom portion 41 and a pair of latch arms 46 on opposite sides of the bottom portion 41. Two pairs of first holes 35, 45 are respectively defined in front portions of the body portion 31 of the upper shield 30 and the bottom portion 41 of the lower shield 40. Two pairs of second holes 34, 44 are respectively defined in rear portions of the body portion 31 of the upper shield 30 and the bottom portion 41 of the lower shield 40.

A pair of press buttons 16 have rear ends integrated with respective opposite sides of the upper cover 10. Two pairs of posts 15, 25 are respectively formed on front portions of inner sides of the upper cover 10 and the lower cover 20, corresponding to the two pairs of first holes 35, 45. Two pairs of screw holes 14, 24 are respectively defined in a rear portion of an inner side of the upper cover 10 and through a rear portion of the lower cover 20. The screw holes 14, 24 correspond to the two pairs of second holes 34, 44.

The strain relief 70 has a holding portion 71, and a front portion 72 having a pair of wing portions 720 protruding laterally from opposite sides thereof.

Figure 3:
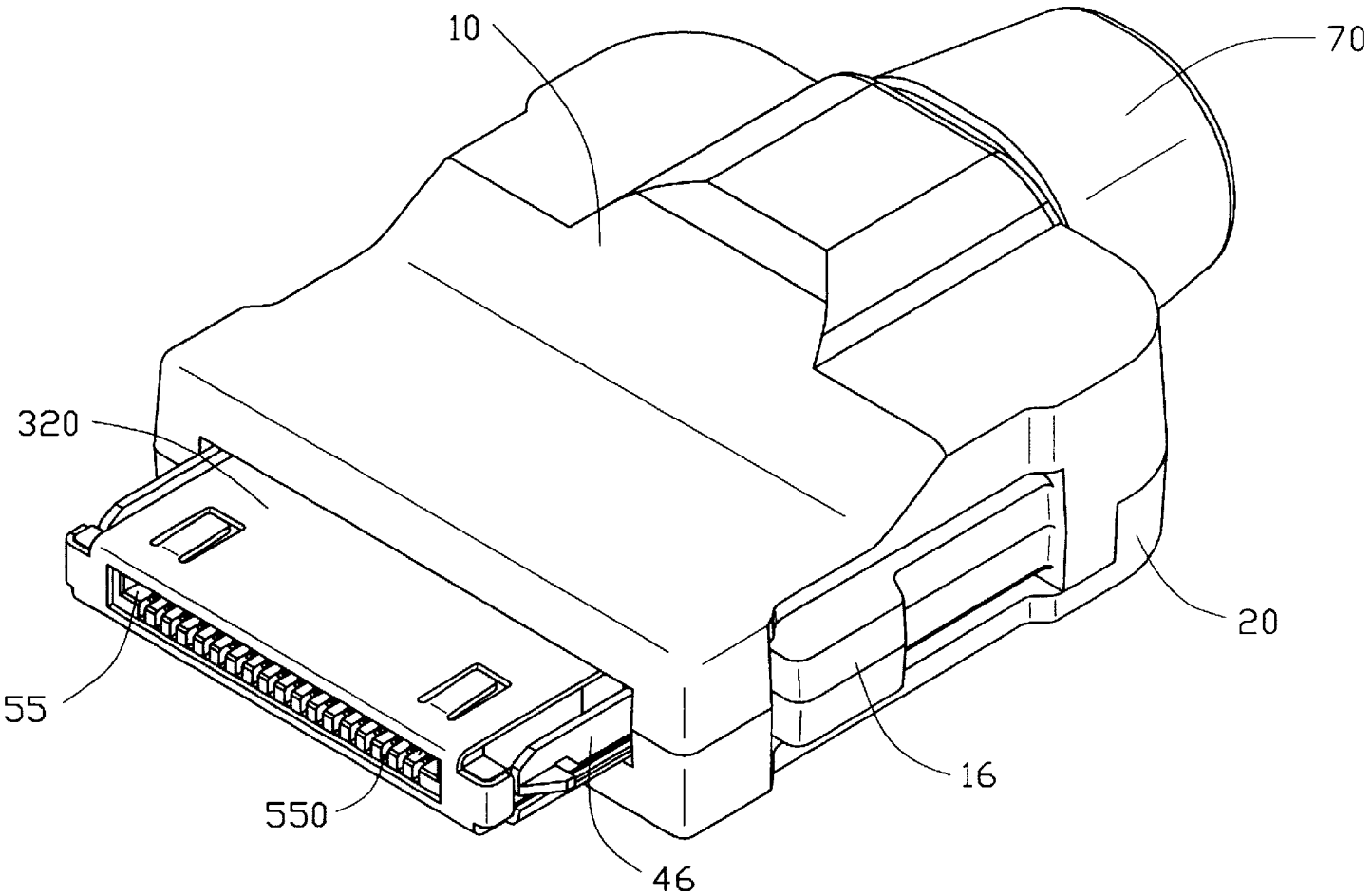
FIG. 3 is an assembled view of FIG. 1.
Figure 4:
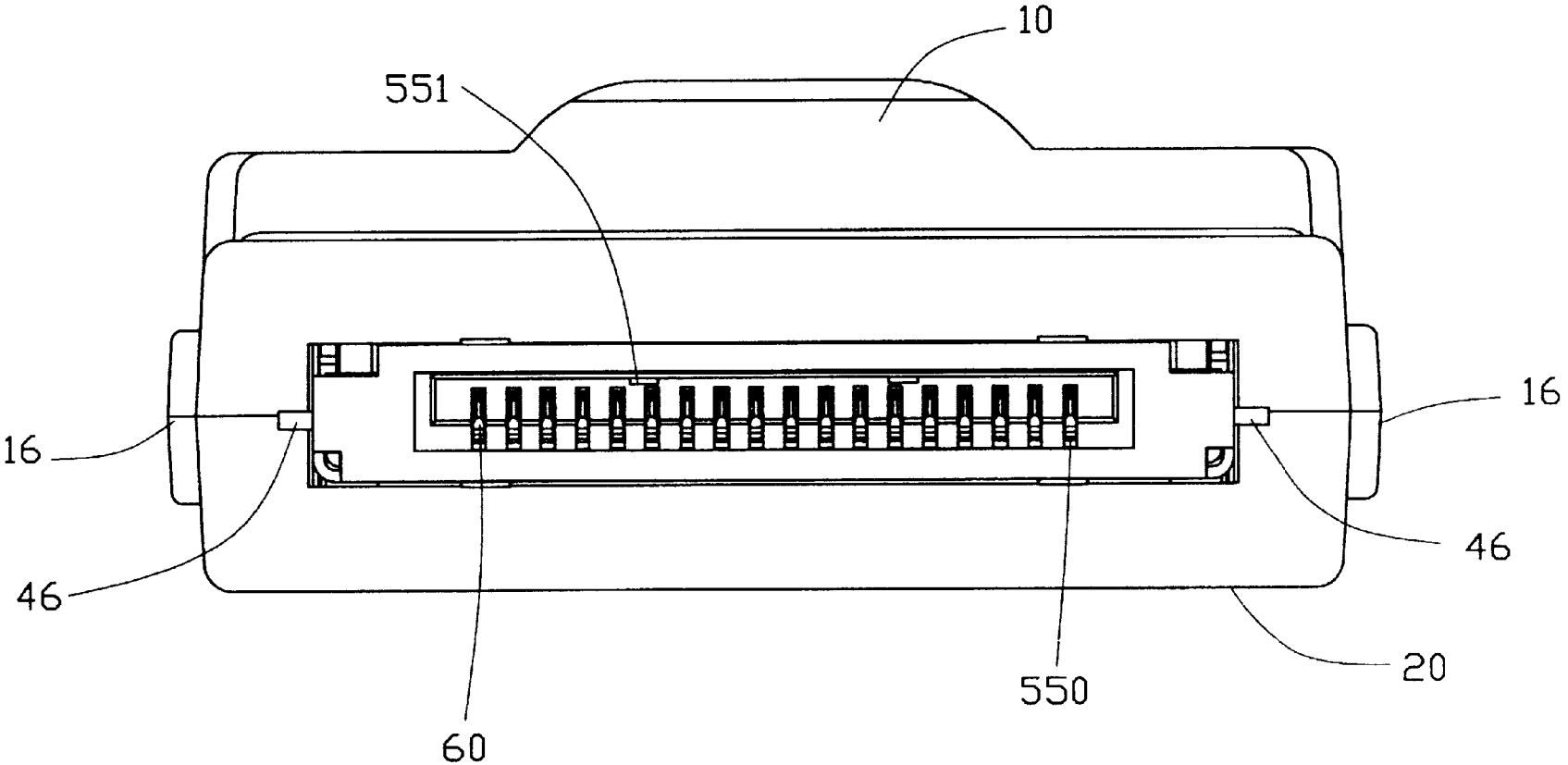
FIG. 4 is a front view of the connector of FIG. 3.

Referring to FIGS. 3 and 4, in assembly, the contacts 60 are inserted into the housing 50, with the contacting portions 61 and the connecting portions 62 being received in corresponding passageways 550, and with the soldering portions 63 being located between the pair of tail portions 56.

The mating portion 53 of the housing 50 is inserted into the head portion 32 of the upper shield 30, with the upper panel 320 and the lower panel 321 of the upper shield 30 respectively attached to an upper and a lower surfaces (not labeled) of the mating portion 53. The lower shield 40 abuts against the upper shield 30, with the bottom portion 41 and the body portion 31 shielding the rear portion 54 of the housing 50 and the soldering portions 63 of the contacts 60 therebetween. The latch arms 46 extend parallel to opposite sides of the mating portion 53, respectively.

The upper cover 10 and the lower cover 20 abut against one another to define a receiving room (not labeled) therebetween. The upper shield 30 and the lower shield 40 are mounted in the receiving room together with the housing 50 and the contacts 60. The posts 15, 25 of the respective upper and lower covers 10, 20 are inserted into corresponding holes 35, 45 of the respective upper and lower shields 30, 40, whereby the positions of the upper shield 30 and the lower shield 40 are fixed in the receiving room. The pair of press buttons 16 of the upper cover 10 respectively abut against the pair of latch arms 46 of the lower shield 40. The mating portion 53 of the housing 50, the head portion 32 of the upper shield 30 and the latch arms 46 of the lower shield 40 extend forwardly out of the receiving room.

The wing portions 720 of the strain relief 70 are immovably received in a rear portion of the receiving room. The holding portion 71 extends rearwardly away from the receiving room to hold a cable (not shown), wires of which are electrically connected with the soldering portions 63 of the contacts 60.

The screws 80 are inserted through the corresponding screw holes 24, the second holes 44, 34 and the screw holes 14 in turn. The screws 80 are then screwed down to ensure that the upper shield 30 and the lower shield 40 are securely mounted between the upper cover 10 and the lower cover 20.

Figure 5:
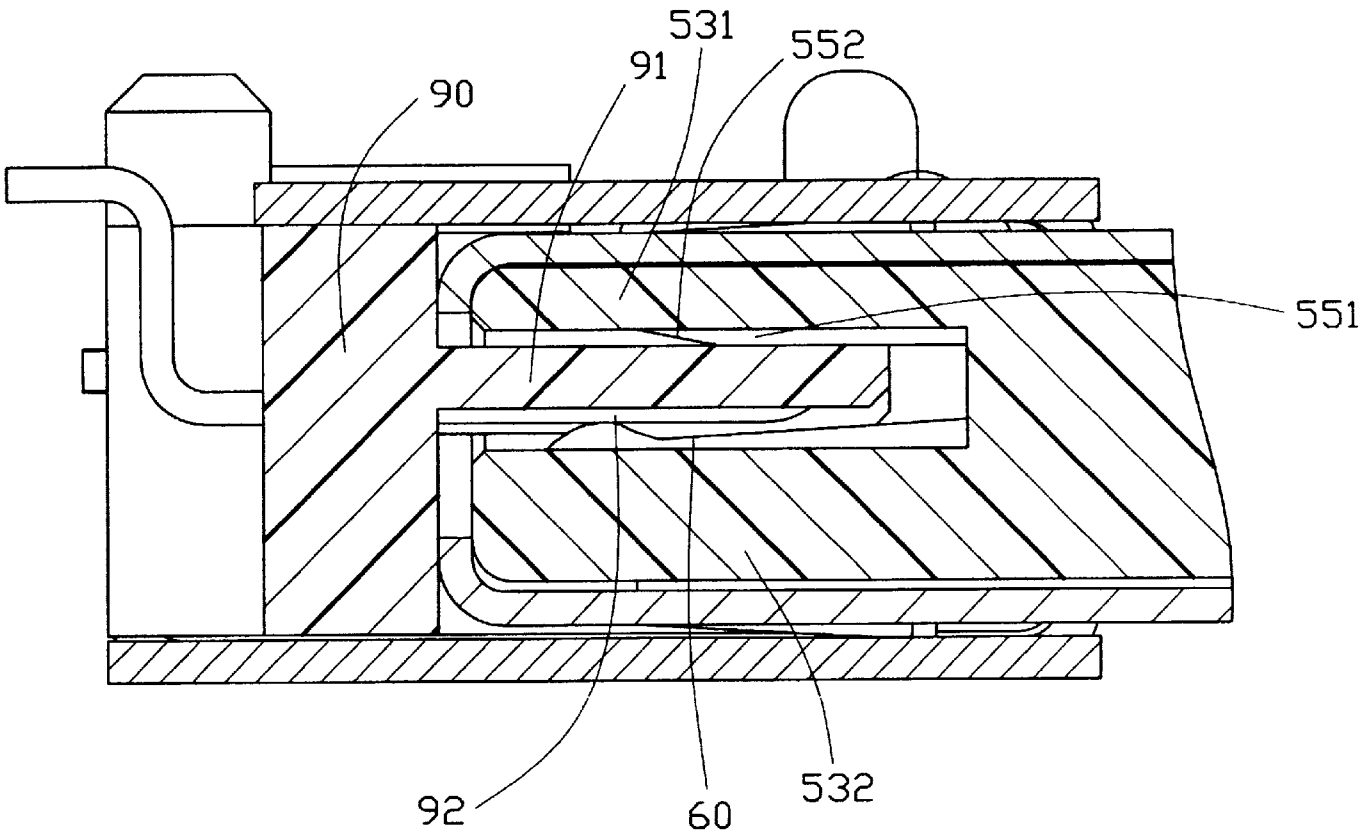
FIG. 5 is a partial, cross-sectional view showing the connector of FIG. 3 mating with a complementary connector.

Particularly referring to FIGS. 4 and 5, a pair of parallel engaging bars 551 project downwardly from the upper wall 531 of the housing 50 into the receiving cavity 55, and extend in a rear-to-front direction. A front end of each engaging bar 551 is cut to form an inclined surface 552 adjacent to a front end of the mating portion 53.

A complementary connector 90 for mating with the electrical connector 1 has an insulative tongue portion 91 and a plurality of conductive terminals 92 mounted on a lower surface of the tongue portion 91. During the mating process, the tongue portion 91 with the terminals 92 is first inserted into the receiving cavity 55 of the connector 1, without touching either the contacts 60 or the engaging bars 551. When the tongue portion 91 continues moving forwards, the inclined surfaces 552 first, and lower sides of the engaging bars 551 second, engage in sequence with an upper surface of the tongue portion 91, so as to downwardly urge the terminals 92 on the lower surface of the tongue portion 91 to mate with corresponding contacts 60 of the connector 1.

By such a design, a reliable electrical connection between the contacts 60 of the connector 1 and the terminals 92 of the complementary connector 90 is ensured, since mating tolerance between the tongue portion 91 and the receiving cavity 55 is compensated by the engaging bars 551. It is noted that the engaging bars also can be formed on the tongue portion 91 of the complementary connector 90. In the same way, such engaging bars can be employed in any similar connector assembly comprising a plug and a receptacle connector. Dies for the connectors only need to be changed a little, so designs of those dies is low cost and simple It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted to mate with a complementary connector which has a tongue portion with conductive terminals disposed thereon, comprising:

an insulative housing having opposing first and second walls with a receiving cavity defined therebetween;

a plurality of conductive contacts received in the receiving cavity of the housing and positioned on the first wall; and an engaging bar protruding from the second wall into the receiving cavity for pushing against the tongue portion of the complementary connector to ensure reliable engagement between the conductive terminals of the tongue portion and corresponding contacts on the first wall upon insertion of the tongue portion of the complementary connector into the receiving cavity; wherein the engaging bar is formed on a rear portion of the second wall and extends in a rear-to-front direction; wherein the engaging bar comprises an inclined surface at a front end thereof, further comprising a metallic shield having an upper shield and a lower shield for shielding the housing and the contacts, the upper shield having at one end an upper panel and a lower panel opposite to said upper panel.

2. The electrical connector as claimed in claim 1, further comprising a cover receiving the metallic shield, the housing and the contacts therein, and wherein the first and second walls of the housing and the shield partially extend out of the cover.

3. An electrical connector assembly, comprising:

a plug connector having a first mating portion and a plurality of first contacts positioned on the first mating portion; and a receptacle connector having a second mating portion for mating with the first mating portion and a plurality of second contacts positioned on the second mating portion; wherein one of the first and second mating portions comprises an inner engaging bar, and when the plug connector mates with the receptacle connector, the engaging bar urges the other of the first and second mating portions to engage with said one of the first and second mating portions, and makes the first and second contacts reliably connect with each other; wherein the engaging bar is formed on a rear portion of said one of the first and second mating portions, and extends in a rear-to-front direction; wherein the engaging bar comprises an inclined surface at a front end thereof; wherein the plug connector comprises a receiving cavity, and the receptacle connector comprises a tongue portion formed as the second mating portion to be inserted into the receiving cavity of the plug connector, further comprising a metallic shield having an upper shield and a lower shield for shielding a housing of the plug connector and the first contacts, the upper shield having at one end an upper panel and a lower panel opposite to said upper panel.

4. The electrical connector assembly as claimed in claim 3, wherein the plug connector has upper and lower walls on opposite sides of the receiving cavity, and the tongue portion of the receptacle connector comprises upper and lower surfaces, and wherein the first contacts are positioned on the lower wall, and the second contacts are positioned on the lower surface.

5. The electrical connector assembly as claimed in claim 4, wherein the engaging bar is formed on one of the upper wall of the plug connector and the upper surface of the tongue portion of the receptacle connector.

* * * * *